United States Patent [19]

Baughman

[11] Patent Number: 4,507,344

[45] Date of Patent: Mar. 26, 1985

[54] PIN WITH DETACHABLE FACE

[76] Inventor: Daniel G. Baughman, P.O. Box 541, Darien, Wis. 53114

[21] Appl. No.: 575,774

[22] Filed: Feb. 1, 1984

[51] Int. Cl.[3] ..... A44C 3/00; B32B 3/06

[52] U.S. Cl. ..... 428/99; D11/41; D11/87; 24/90 A; 24/103; 428/542.4

[58] Field of Search ..... 428/7, 11, 26, 99, 542.2, 428/542.4; 63/20, 29; D11/41, 47, 87, 88; D2/414, 416, 419, 420; 24/90 A, 94, 103, 621

[56] References Cited

U.S. PATENT DOCUMENTS

| | | | |
|---|---|---|---|
| 590,768 | 9/1897 | Neider | D11/47 X |
| 783,941 | 2/1905 | Farnham | 24/103 |
| 1,146,696 | 7/1915 | Eisenkramer | 428/99 |
| 2,017,377 | 10/1935 | Schemmel | 428/99 X |
| 2,043,321 | 6/1936 | Fleischer | 428/99 |
| 2,144,926 | 1/1939 | Lawton | 63/20 |
| 2,198,558 | 4/1940 | Handman | 63/20 |
| 2,948,936 | 8/1960 | Winthrop | 428/11 X |
| 3,045,309 | 7/1962 | Johnson, Sr. | 24/94 X |
| 3,083,430 | 4/1963 | Shears | D2/416 X |
| 3,088,295 | 5/1963 | Haines | 428/26 X |
| 3,210,820 | 10/1965 | Humiston | D2/416 X |
| 3,831,398 | 8/1974 | Davis, Sr. | 428/16 X |
| 4,344,240 | 8/1982 | Schiller | 24/90 A |

OTHER PUBLICATIONS

Page 21, Luggage and Leather Goods, May 1966.

*Primary Examiner*—Henry F. Epstein

[57] ABSTRACT

A pin with a detachable face includes an elongate pointed shaft having a face receiving snap portion coupled thereto. The detachable face includes a decorative face portion and a back which includes a snap portion integral therewith. A locking mechanism may be used with the shaft if the pin is worn on clothing or the pin may be used without the locking mechanism.

2 Claims, 6 Drawing Figures

PIN WITH DETACHABLE FACE

BACKGROUND OF THE INVENTION

1. Field of he Invention

The present invention relates generally to the art of decorative pins and in particular to pins which include decorative faces. Still more specifically, the present invention relates to pins having removable decorative faces. The decorative pins may be length-of-service pins for employees, golf ball markers, jewelry, collectables, pins to indicate membership in various organizations, tie-tacs, etc.

2. Description of the Prior Art

Many different types of decorative pins are known to the art. Two types will briefly be mentioned here as examples. A first type of pin includes a face member having an elongate, pointed shaft coupled thereto. This type of pin may be inserted into or through any suitable surface to display the face. In some instances, a securing mechanism is used to retain the pin in place, such as the type of locking mechanism typically associated with tie-tacs. Such retainers receive the shaft and grip the shaft. The shaft is removed from the retainer by exerting pulling force or by manipulating the retainer. Another example of a suitable retainer is the type typically used to secure pierced-ear earrings after the shaft has been passed through the lobe. A wide variety of other types of retainers are also known.

A second type of decorative pin includes a hinge member on the back of the decorative face with a pointed pin shaft. In a first position the shaft is perpendicular to the face and in a second position the shaft is parallel thereto. After such pins are inserted through the surface, for example a piece of clothing, the pin shaft is put into its second position. A locking mechanism is typically included with such pins to prevent loss of the pin and to prevent the sharp end of the pin from injuring the wearer.

These two examples are intended to represent only a few of the types of pins with which the present invention may be used. Besides the types of pin structures described above, it is also well known that such pins have a wide variety of uses. Again, only a few such uses need to be described here to indicate to those skilled in the art the wide applicability of the present invention. Such uses include mens and ladies jewelry and fashion accessories (e.g. tie-tacs and lapel pins), service pins such as those given to employees on their anniversaries of employment, pins used to designate membership in or support of various organizations (e.g. religious or charitable organizations), pins sold as souvenirs (e.g. pins sold by tourist attractions or entertainment personalities), pins of fraternal organizations, etc. Moreover, many types of such pins are now being collected by individuals and more expensive pins are being offered because of the interest of collectors in such items.

While such pins are in widespread use, the present inventor is not aware of any such pins which have a decorative face which is detachable from the pin body and fastening components. Pins having such a feature would represent a significant advance in the art and would facilitate the manufacture, sale, storage and display of such articles, and would reduce the manufacturing costs thereof. As an example, if a corporation gave its employees length of service pins on every 5th anniversary with the company, only the face of the pin would be changed and the fastening system could be used over and over again. As another example, if an individual collects pins of various entertainment groups, the face could be periodically interchanged without the need for buying a number of backing members.

Another field of prior art related to the present invention is ball markers used by golfers to mark the location of a golf ball on the putting surface. Simple markers are available which include a circular plastic disc having a perpendicular pin shaft attached to the center thereof. The marker is used by simply pressing the disc down into the grass surface so the disc is flush with or slightly below the grass level. Another type of ball marker is one which is part of the snap of a golf glove and includes a round disc face having the male portion of a socket-type snap affixed to its rear surface. The female portion of the snap is sewn to the back of the glove. This marker is used by unsnapping the disc and using it as previously described for the plastic disc marker.

These types of ball markers typically include some decorative feature, such as advertising for equipment manufacturers, the name of a golf resort or country club, etc. It is important to the golfer to be able to quickly and conveniently gain access to his marker during the game, but it is also becoming increasingly popular to use more expensive markers and the collecting of such markers is becoming an increasingly popular hobby for golfers. Country club or resort pins are becoming popular and may be made out of expensive metals or may contain jewels. Use of such pins as ball markers and providing such pins with replaceable face members would provide numerous advantages.

OBJECTS AND SUMMARY OF THE INVENTION

It is a primary object of the present invention to provide a pin which may be attached to clothing or another surface and which has a readily detachable face portion.

Another object of the present invention is to provide a system for allowing replacement or substitution of a variety of pin face members on a pin portion including means for securing the pin to the desired surface.

A further object of the present invention is to provide a detachable face system which may be readily adapted to pin bases having a variety of attachment devices.

How these and other objects of the present invention are accomplished will be described in the following specification taken in conjunction with the drawings. Generally, however, the objects are accomplished with a pin having two major portions. The first portion includes a face which may have decorative matter on it. An attachment device is affixed to the rear surface of the face. The second major portion is a base which includes two sub-components, i.e. a first attachment device for cooperating with the attachment device of the face to secure the two major components together and a second attachment device for securing the pin to a selected surface, e.g. clothing. In the preferred embodiment, the second attachment device includes an elongated, pointed shaft secured to the second portion and a locking member adapted to surround and grip the shaft after the shaft is pushed through the clothing.

DESCRIPTION OF THE PREFERRED AND ALTERNATE EMBODIMENTS

Figure 1:
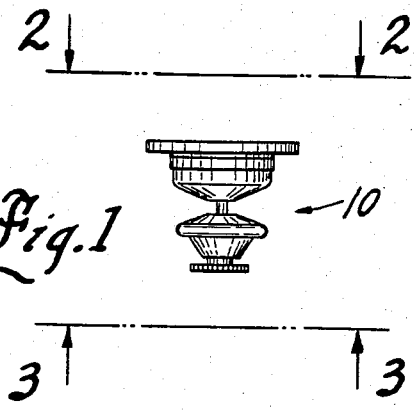
FIG. 1 is a side elevation of a pin with detachable face according to the preferred embodiment of the present invention.
Figure 2:
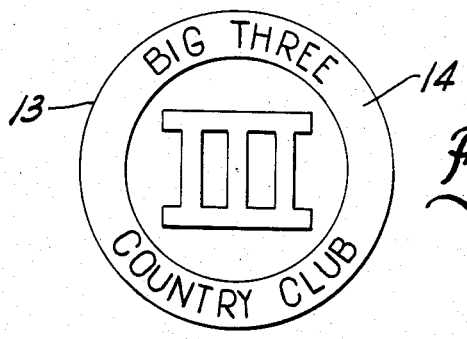
FIG. 2 is a top plan view taken along the line 2—2 of FIG. 1.
Figure 4:
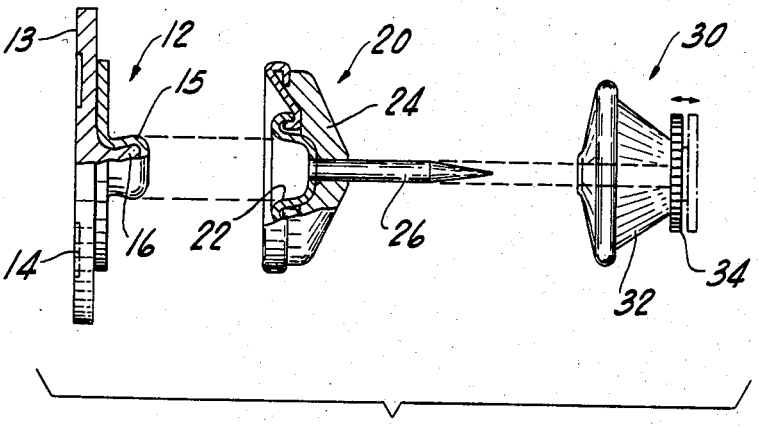
FIG. 4 is an exploded side view of the pin shown in FIG. 1 showing the face, base and securing members used in the preferred embodiment of the present invention with parts broken away in section.

FIG. 1 shows a pin 10 according to the primary or preferred embodiment of the invention in a fully assembled or as worn form. The individual components are best shown in FIG. 4 which will be used to explain the preferred embodiment in detail. The first component is the face 12. Face 12, in the illustrated embodiment, includes a thin circular disc 13 having decorative matter on its front surface 14 as illustrated in FIG. 2. The type of decorative matter does not form part of the present invention, but for purposes of illustration, the face contains the name and logo of a fictitious country club.

Disc 13 may be prepared from any suitable material, such as metals or plastics, with pewter being preferred. Disc 13 is joined to and is integral with the male portion 15 of a common snap, it being shown in FIG. 4 that the disc 13 includes a protrusion 16 which fills the inner cavity of snap portion 15. Any suitable alternative technique could be employed for joining items 13 and 15, such as the use of adhesives. The decorative matter may be added to front surface 14 of disc 13 prior to the assembly with snap portion 15 or may be added at the time snap portion 15 is added.

Figure 6:
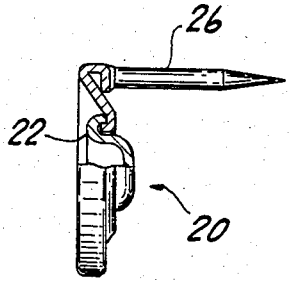
FIG. 6 is a side elevation view of a second alternate embodiment of the present invention.

The second component of pin 10 is the base portion 20 which itself may include two or three parts. The first of such parts is the female portion 22 of the snap. The second part, the one which may be eliminated, is a base 24 which is shaped like a truncated cone and the third component which is an elongate pointed shaft 26. In the illustrated embodiment, the three parts are integral with one another and are joined in a molding process in which the base 24 is added in molten form and is allowed to solidify in contact with the other two elements. Other manufacturing techniques, such as the use of adhesives, could also be employed. If base 24 is eliminated, shaft 26 would be welded or otherwise suitably attached to portion 22 (See FIG. 6), either perpendicularly or at an angle as the end use of pin 10 dictates. Shaft 26 may be centered on portion 22 or may be attached (as illustrated) on the periphery thereof.

The third major component of pin 10 is a locking member 30 which itself is well known in the art and which will be described only in general terms. Locking member 30 includes a first body 32 having a hole therethrough for receiving the free end of shaft 26. Within body 32 are locking elements (not shown) which grip shaft 26 against longitudinal pulling forces. Locking member 30 also includes a release ring 34 which is movable between the full line position shown in FIG. 4 and the dotted line position shown in FIG. 4. Release ring 34 is coupled to the locking elements and shaft 26 is released when the ring 34 is moved to its dotted line position. Locking member 30 may be identical to the locking member commonly used with jewelry, such as tie-tacs.

Now that the major components of pin 10 have been described, it is appropriate to mention that any of the uses for such pins described in the "Description of the Prior Art" section of this specification are applicable with pin 10, e.g. jewelry applications, recognition pins, golf ball markers and the like. The ball marker application is especially suited for the present invention because pin 10 can be worn on a golf shirt or can be pinned to the golf bag. Face member 12 is removed by lifting it with a slight twisting motion from base member 20 and is just as easily reattached after use by inserting portion 15 of face member 12 into the snap receptacle 22 of base 20.

Figure 5:
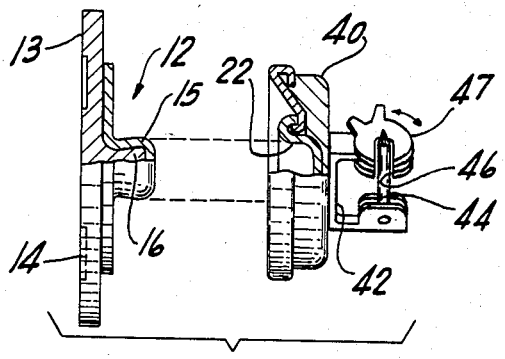
FIG. 5 is a side elevation view of an alternate embodiment of the present invention showing a different type of base and attachment system than that shown in FIGS. 1-4.
Figure 3:
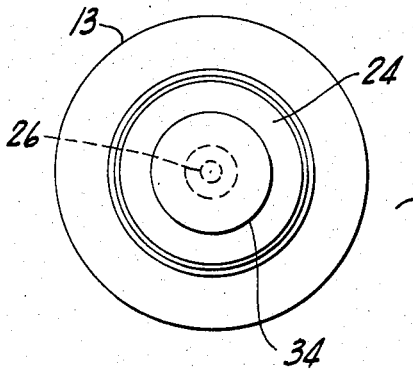
FIG. 3 is a bottom plan view taken along the line 3—3 of FIG. 2.

FIG. 5 is provided to show the adaptability of the present invention to other types of pins and differs from the preferred embodiment only in the shape of the base member and the type of pin shaft and locking mechanism employed. Instead of the truncated cone shape for the base, the base 40 in FIG. 5 is disc shaped and has a flat back surface 42. Molded to base 40 is a hinged shaft 44 movable between a first position (not shown) where the shaft is nearly perpendicular to the base 40 to a second portion where the free end of the shaft 44 is received and locked into a recess 46 by a rotatable lock 47. As previously mentioned, this type of pin shaft and lock is well known to the art and in and of itself forms no part of the present invention. It should also be mentioned here that base 40 can be eliminated and the attachment device could be welded directly to snap portion 22 (in a manner similar to that illustrated in FIG. 6).

It is also possible with the present invention to use a wide variety of snap or attachment devices instead of the illustrated snaps. Other kinds of snaps can be used or Velcro could be used on the two components. So while a preferred and alternate form of the invention have been illustrated and described, the invention is not to be limited thereby, but is to be limited solely by the claims which follow.

I claim:

1. A pin comprising a face member having a first generally planar face surface and a rear surface, a protrusion extending from said rear surface and being integral with said face member, a snap means secured to said protrusion, said pin also comprising a base means having a snap receptacle adapted to releasably receive said snap means and an elongate pin shaft secured thereto.

2. The invention set forth in claim 1 wherein said face member is metal and wherein said snap means is a separate element secured about said protrusion and wherein said pin shaft is welded to said base means.

* * * * *